United States Patent [19]

Heismann

[11] 4,300,295

[45] Nov. 17, 1981

[54] SNOW THROWER IMPELLER ASSEMBLY

[75] Inventor: Richard A. Heismann, Knoxville, Ill.

[73] Assignee: Outboard Marine Corporation, Waukegan, Ill.

[21] Appl. No.: 111,821

[22] Filed: Jan. 14, 1980

[51] Int. Cl.[3] ..... E01H 5/00

[52] U.S. Cl. ..... 37/43 D; 198/676

[58] Field of Search ..... 37/43 R–43 L, 37/53, 24; 198/664, 676, 677, 638, 659, 661–663, 669, 670, 671; 56/156, 289, 294; 172/532

[56] References Cited

U.S. PATENT DOCUMENTS

| | | | |
|---|---|---|---|
| 1,293,321 | 2/1919 | Brisben | 56/294 |
| 2,124,927 | 7/1938 | Peter | 37/43 R |
| 2,521,262 | 9/1950 | Smith | 56/294 |
| 2,919,504 | 1/1960 | Rubin | 37/43 R X |
| 3,359,661 | 12/1967 | Speiser et al. | 37/53 X |
| 3,363,345 | 1/1968 | Ober | 37/43 R |
| 3,452,460 | 7/1969 | Cope et al. | 37/53 X |
| 3,484,963 | 12/1969 | Heth et al. | 37/43 R |
| 3,548,522 | 12/1970 | Roper | 37/43 R |
| 4,203,237 | 5/1980 | Enters et al. | 37/43 E |

FOREIGN PATENT DOCUMENTS

| | | | |
|---|---|---|---|
| 31365 | 1/1908 | Austria | 56/294 |
| 33152 | 6/1908 | Austria | 56/294 |
| 960708 | 1/1975 | Canada | 37/43 C |
| 57282 | 7/1922 | Sweden | 56/294 |
| 1461 | of 1907 | United Kingdom | 56/294 |

*Primary Examiner*—E. H. Eickholt

*Attorney, Agent, or Firm*—Michael, Best & Friedrich

[57] ABSTRACT

The snow thrower includes a housing having a transversely extending discharge chute and an impeller rotatably mounted in the housing below the discharge chute and carrying a plurality of elongated, axially extending blades having a length substantially coextensive with the width of the discharge chute and a radially outwarding extending propelling section. The propelling section is in the form of a continuous series of corrugations with alternating peaks or ridges and valleys or furrows defining a plurality of generally V-shaped cups or pockets into which snow is compacted and from which snow is propelled upwardly toward the discharge chute during rotation of the impeller.

13 Claims, 5 Drawing Figures

SNOW THROWER IMPELLER ASSEMBLY

BACKGROUND OF THE INVENTION

This invention relates to snow throwers and, more particularly, to walk-behind snow throwers having a rotary impeller for throwing snow upwardly through a discharge chute.

Two general types of walk-behind snow throwers are most widely used today. One type employs an auger impeller which compacts the snow, moves it toward the center and propels the compacted snow from the central location upwardly through a constricted discharge chute. The other type employs a blade or paddle impeller which slaps into the snow and throws it, across the entire width of the impeller without compacting, upwardly through a plurality of adjustable direction or deflector vanes. The discharge chute of the first type can become clogged, particularly when the snow is wet, in which case the operator must shut the unit down to clear the chute by hand. While the second type is less vulnerable to clogging, the snow is discharged into the air in powder form and can be blown backwards into the area being cleared or into the operator's face.

Examples of prior art constructions for walk-behind snow throwers employing an auger type impeller are disclosed in the following U.S. Patents:

| PATENTEE | NUMBER | ISSUE DATE |
|---|---|---|
| Ober | 3,363,345 | January 16, 1968 |
| Heth et al | 3,484,963 | December 23, 1969 |

Examples of prior art constructions for walk-behind snow throwers employing a blade or paddle type impeller and for impeller blades therefore are disclosed in the following U.S. Patents:

| PATENTEE | NUMBER | ISSUE DATE |
|---|---|---|
| Rubin | 2,919,504 | January 5, 1960 |
| Speiser et al | 3,359,661 | December 26, 1967 |
| Cope et al | 3,452,460 | July 1, 1969 |
| Roper | 3,548,522 | December 22, 1970 |

The Peter U.S. Patent No. 2,124,927 discloses a vehicle-mounted snow plow employing laterally spaced scoops which collect the snow and propels it through separate constricted discharge chutes.

SUMMARY OF THE INVENTION

The invention provides a snow thrower impeller assembly including paddle or blades arranged to compact the snow so as to minimize blowing after discharge and yet throws the snow across the full width of the impeller upwardly through a discharge chute having a width substantially coextensive with the impeller so as to minimize clogging.

More specifically, the invention provides a snow thrower comprising a housing mounted on ground engaging wheels and having a transversely extending discharge chute, an impeller mounted in the housing below the discharge chute for rotation about a transverse axis and carrying one or more elongated, axially extending blade having a length substantially coextensive with the width of the discharge chute, and a power source for rotating the impeller. Each blade has a radially outwardly extending propelling section in the form of a continuous series of undulations or corrugations with alternating peaks or ridges and valleys or furrows defining a plurality of generally V-shaped cups or pockets in which snow is compacted and from which snow is thrown upwardly towards the discharge chute during rotation of the impeller.

In one embodiment, each blade has a body including a generally planar web section having leading and trailing edges and the propelling section extends radially outwardly from the trailing edge of the web section, preferably at an oblique angle to the web section.

In one embodiment, the impeller includes a support assembly rotatably mounted on the housing. The support assembly can include a pair of laterally spaced hub members and a plurality of elongated, transversely extending shell members, corresponding in number to the number of impeller blades, and carried on the hub members. Each of the shell members includes a body portion terminating at one transverse edge in a first blade mounting section and terminating at the opposite transverse edge in a second blade mounting section. The shell members are mounted on the hub members with a first blade mounting section of one shell member and a second blade mounting section of another shell member in overlapping relationship and secured together with an impeller blade body sandwiched therebetween.

The blades, including the body and propelling section, can be formed as a one-piece unit, such as by molding from an elastomeric or resinous thermoplastic material.

The invention also provides an impeller for a snow thrower comprising a rotatable, axially-elongated support assembly and an elongated, axially extending blade mounted on the support assembly and having a radially outwardly extending propelling section, the propelling section of the blade being in the form of a continuous series of corrugations with alternating ridges and furrows defining a plurality of V-shaped pockets.

One of the principal features of the invention is the provision of a snow thrower including a non-clogging, compacting impeller.

Another of the principal features of the invention is the provision of a snow thrower having a impeller including a plurality of blades which extend substantially coextensive with a transverse discharge chute and which are arranged to compact the snow during movement therethrough.

A further of the principal features of the invention is the provision of a snow thrower impeller including a blade support assembly arranged to securely and reliably retain the impeller blades against the centrifugal forces imposed thereon.

Other features and advantages of the invention will become apparent to those skilled in the art upon reviewing the following detailed description, the drawings and the appended claims.

Figure 1:
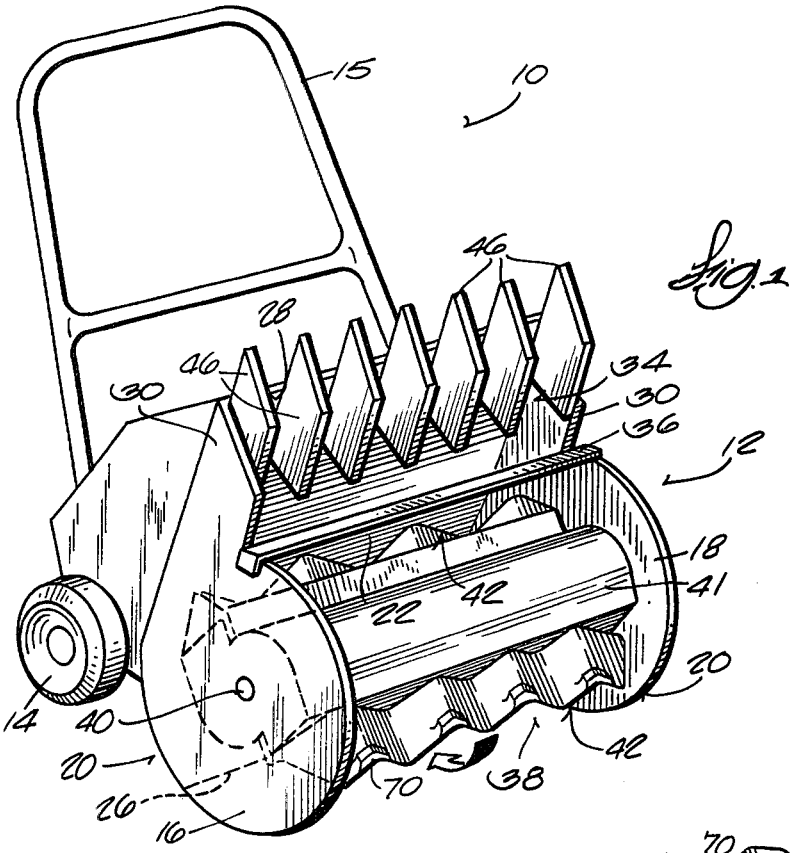
FIG. 1 is a perspective view of a snow thrower embodying various of the features of the invention.

Before explaining at least one embodiment of the invention in detail, it is to be understood that the invention is not limited in its application to the details of the construction and arrangement of parts set forth in the following general description or illustrated in the accompanying drawings. The invention is capable of other embodiments and of being practiced or carried out in various ways. Also, it is to be understood that the phraseology or terminology employed herein is for the purpose of description and should not be regarded as limiting.

DETAILED DESCRIPTION

Illustrated in the drawings is a lightweight, walk-behind snow thrower 10 including a housing 12 supported on a pair of laterally-spaced, ground-engaging wheels 14 (one shown) and a rear handle 15 for guiding movement of the snow thrower. The housing 10 includes a pair of laterally spaced, vertical sidewalls 16 and 18, each having an arcuate lower portion 20, and a rear wall 22 having a curved bottom portion terminating at the front end in a transverse scraper edge 26. The rear wall 22 further includes an upper, forwardly inclined portion 28 which cooperates with upper extensions 30 of the side walls 16 and 18 to define a transversely extending discharge chute 34. A cross member 36, connected at the opposite ends to the side walls 16 and 18, serves as a stiffener for the side walls.

Figure 2:
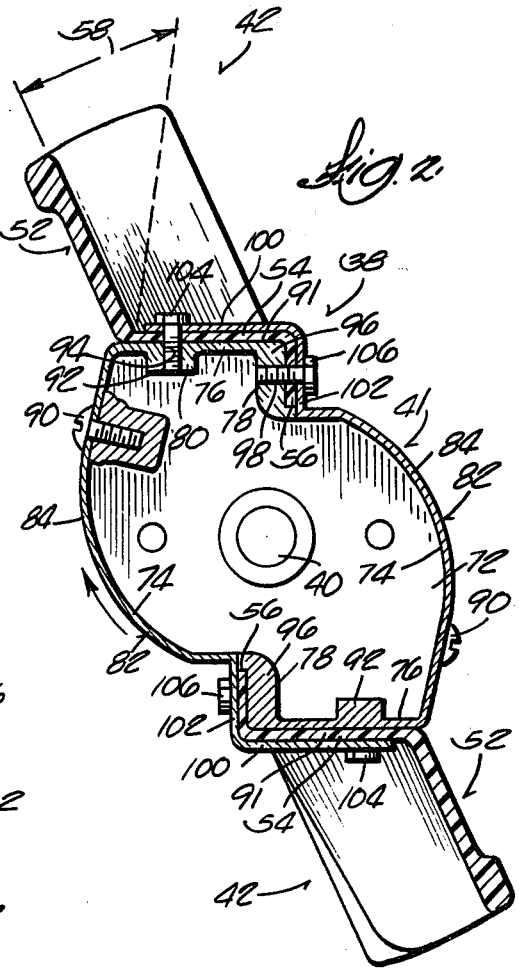
FIG. 2 is a partially sectioned, end elevational view of the impeller assembly of the snow thrower of FIG. 1.

Disposed inside the housing 12 for rotation about a horizontal transverse axis is an impeller assembly 38 including a shaft 40 journalled at the opposite ends in the sidewall lower portions 20 and a drum-like support assembly 41 carrying one or more axially extending impeller blades 42, preferably two diametrically opposed impeller blades 42. The impeller assembly 38 is rotated in a clockwise direction as viewed in FIGS. 1 and 2 by a suitable power source, such as an internal combustion engine or an electrical motor (not shown), through a conventional drive train (not shown).

When an operator walking behind the snow thrower 10 pushes it forwardly into the snow with the impeller assembly 38 operating, the impeller blades 42 bite into the snow and throw it upwardly and forwardly through the discharge chute 34. To minimize clogging, the width of the discharge chute 34 is substantially coextensive with the axial length of the impeller blades 42.

The direction of the snow discharge from the discharge chute 34 is controlled by a plurality of upwardly extending, laterally spaced deflector vanes 46 disposed in the discharge chute 34 in parallel relationship. The deflection vanes 46 preferably are spaced at equal intervals. Extending from the rear edge of each deflector vane 46 is a pivot pin (not shown) which is pivotally mounted on and extends through the upper portion 28 of the rear wall 22 to provide pivotal or angular movement of the deflector vanes 46 between forward or straight ahead, right and left discharge positions with respect to the operator walking behind the snow thrower 10. A manually operated control mechanism (not shown) located exteriorly of the discharge chute 34 and connected to the outer ends of the deflector vane pivot pins is operable for selectively pivoting the deflector vanes 46 in unison between the forward, right and left discharge positions.

The impeller blades 42 are arranged to compact the snow and thereby minimize indiscriminate blowing upon being discharged into the air. More specifically, each impeller blade 42 (FIGS. 2 and 3) has a body 50 for mounting on the support assembly 41 and a propelling section 52 which provides a compacting action during rotation of the impeller assembly 38. The body 50 includes a generally planar web section 54 and and shoulder 56 depending from the leading edge of the web section 54. The propelling section 52 extends from the trailing edge of the web section 54 at an oblique angle relative to the plane of the web section 54. As a guide, the included angle between the propelling section 52 and a plane perpendicular to the plane of the web section 54, designated by reference numeral 58 in FIG. 2, can be about 25°.

To provide the desired snow compaction, the propelling section 52 (FIG. 3) is in the form of a continuous series of undulations or corrugations including a plurality of parallel peaks or ridges 64 and valleys or furrows 66 defining a plurality of generally V-shaped cups or pockets 68. The snow is picked up by the leading edge of the propelling section 52, forced into the pockets 68 and compacted by the rotational movement of the impeller assembly 38. During continued rotation, the compacted snow is thrown upwardly from the pockets 68 toward the discharge chute 34.

The propelling section 52 has a substantially uniform thickness except for a thickened leading tip portion 70 in the vicinity adjacent of each ridge 64. This is the area of initial contact with the snow where the highest impact and stress loads occur, particularly when stones and similar foreign objects are encountered.

While various suitable construction can be used, in the specific construction illustrated, the impeller blades 44, including the web section 54, the shoulder 56 and the propelling section 52, is formed as a one-piece unit, preferably molded from an elastomeric material, such as the elastomeric thermoplastic polyester Hytrel 5556 marketed by E. I. DuPont, or a more rigid synthetic resinous thermoplastic material.

Means are provided for securing the impeller blades 42 on the support assembly 41. In the specific construction illustrated, the support assembly 41 (FIG. 2) includes a pair of generally S-shaped hub members 72 (one shown) carried on the opposite ends of the shaft 40. Each hub member 72 has opposed arcuate surfaces 74 and opposed, generally flat, angularly related first and second mounting surfaces 76 and 78. Each of the first mounting surfaces 76 includes a recess 80. The hub members 72 preferably are molded from an inexpensive, synthetic resinious thermoplastic material, such as polyethylene.

Figure 3:
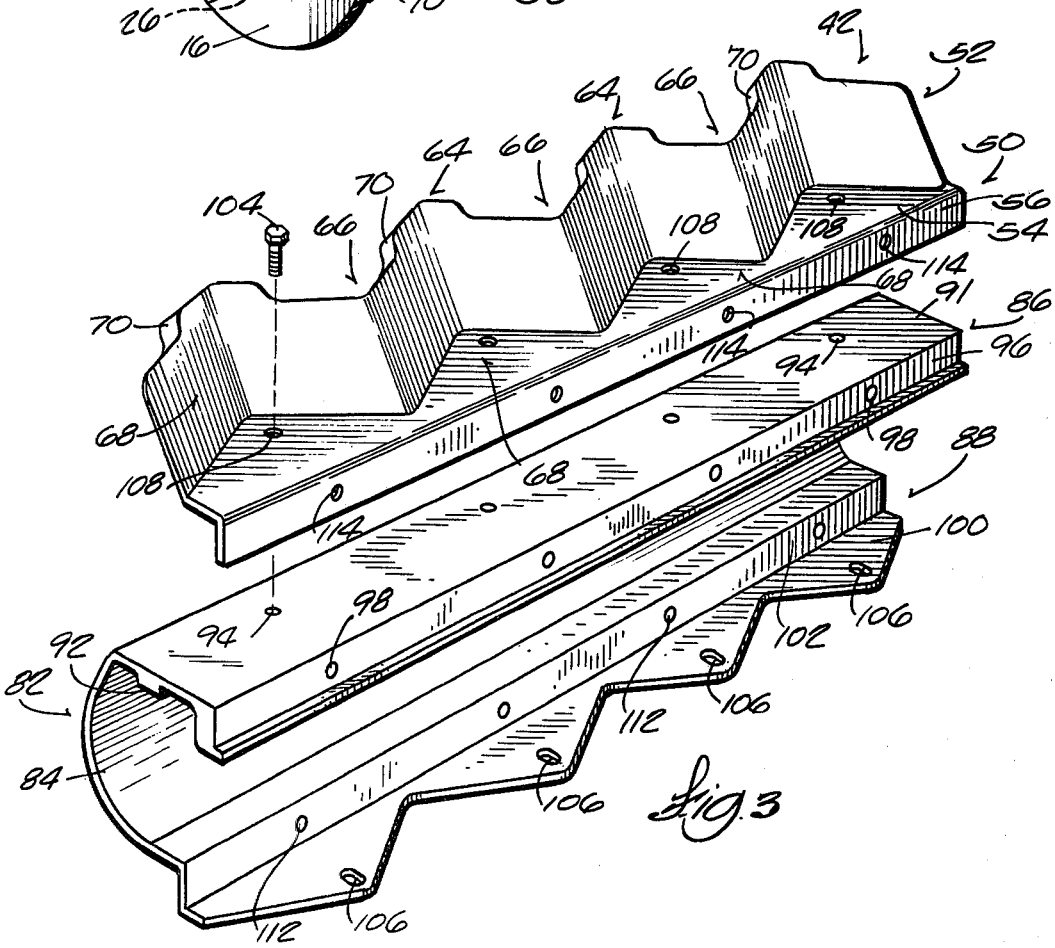
FIG. 3 is an exploded, perspective view of certain parts of the impeller assembly.
Figure 5:
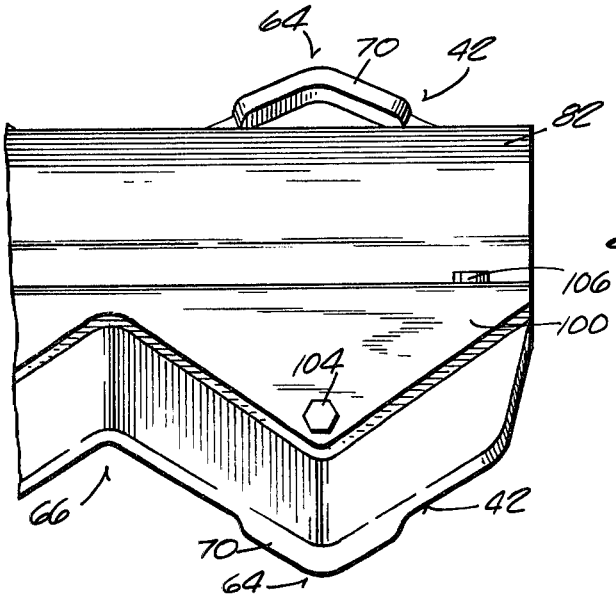
FIG. 5 is a partial top plan view of the impeller assembly illustrated in FIG. 2.
Figure 4:
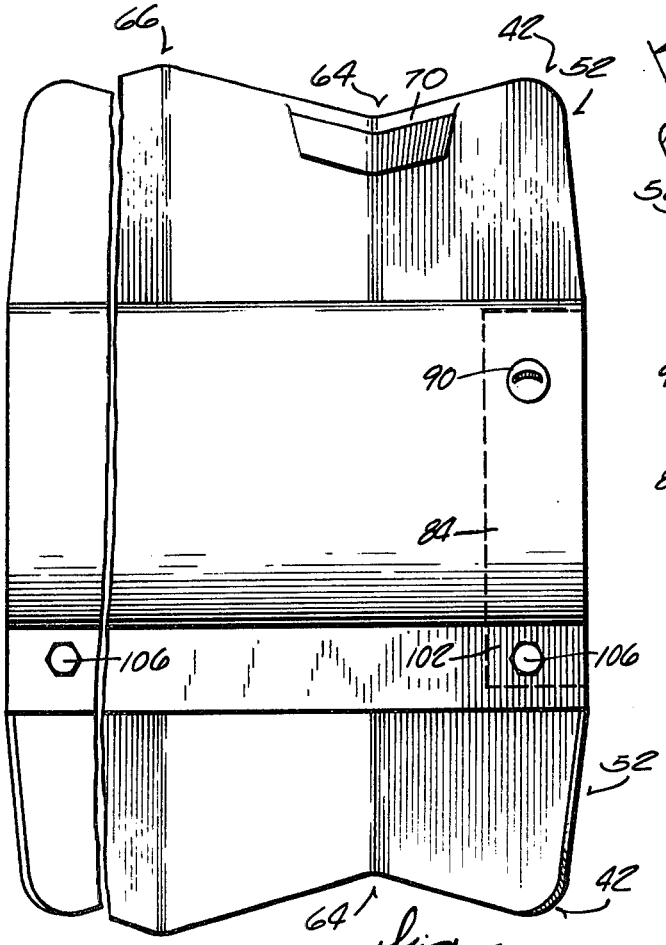
FIG. 4 is a partial, side elevational view of the impeller assembly illustrated in FIG. 2.

The impeller blades 42 are secured on the hub members 72 by a pair of identical, elongated shell members 82 which, when mounted on the hub members 72, define a hollow drum. The shell members 82 preferably are formed from a light weight metal such as by extruding an aluminum alloy. As best shown in FIG. 3, each shell member 82 has an arcuate body 84, a first hook-like blade mounting section 86 extending from one transverse edge of the body 84, and a second L-shaped, blade mounting section 88 extending from the other transverse edge of the body 84. The opposite ends of the body 84 (FIG. 2) fit against an arcuate surface 74 of a hub member 72 and are secured thereto with a tap screw 90 or the like.

The first blade mounting section 86 of each shell member 82 has a shelf portion 91 including, on the underside, a transversely extending protuberance 92 which is provides with a plurality of threaded mounting holes 94. The first blade mounting section 86 also includes an inturned flange 96 which is provided with a plurality of threaded mounting holes 98.

The second blade mounting section 88 of each shell member 82 has a saw tooth-shaped portion 100 which has the same general configuration of and fits against the top surface of an impeller blade web section 54 and also has shoulder 102 which fits against an impeller blade flange 56.

The shell members 72 are secured together with the web section 54 and the flange 56 of an impeller blade 72 sandwiched between a first blade mounting section 86 of one shell member 82 and an overlapping a second mounting section 88 of the other shell member 82. Such an arrangement provides a simple and reliable means for securely holding the impeller blades 42 against the centrifugal forces imposed thereon during impeller rotation. In the particular construction illustrated, the shell members 82 are fastened together by bolts 104 extending through apertures 106 in the saw tooth portion 100 and through apertures 108 in the impeller blade web section 54 and threaded into mounting holes 94 and by bolts 110 extending through apertures 112 in the shoulder 102, and through apertures 114 in the impeller blade flange 56 and threaded into mounting holes 98.

Various of the features of the invention are set forth in the following claims:

What is claimed is:

1. A snow thrower comprising a housing supported on ground engaging wheels and having a transversely extending discharge chute, an impeller mounted on said housing below said discharge chute for rotation about a transverse axis and an elongated axially extending blade having a length substantially coextensive with a width of said discharge chute and a radially outwardly extending propelling section, said propelling section being in the form of a continuous series of corrugations with alternating ridges and furrows defining a plurality of generally V-shaped pockets into which snow is compacted and from which snow is propelled toward said discharge chute during rotation of said impeller, and a power source for rotating said impeller.

2. A snow thrower according to claim 1 wherein said impeller includes a support assembly rotatably mounted on said housing and means for securing said impeller blade on said support assembly.

3. A snow thrower comprising a housing supported on ground engaging wheels and having a transversely extending discharge chute, an impeller including a support assembly rotatably mounted on said housing below said discharge chute for rotation about a transverse axis, an elongated axially extending blade having a length substantially coextensive with the width of said discharge chute and including a body portion including a generally planar web section having leading and trailing edges with respect to the direction of rotation of said impeller and a propelling section which extends radially outwardly from said trailing edge and which is in the form of a continuous series of corrugations with alternating ridges and furrows defining a plurality of generally V-shaped pockets into which snow is compacted and from which snow is propelled toward said discharge chute during rotation of said impeller, means for securing said impeller blade on said support assembly, and a power source for rotating said impeller.

4. A snow thrower according to claim 3 wherein said propelling section extends at an oblique angle to said web section.

5. A snow blower according to claim 3 wherein said body and propelling section are formed as a one-piece unit.

6. A snow thrower according to claim 3 wherein said propelling section has a substantially uniform thickness except for a thickened tip portion in the vicinity adjacent each ridge of said corrugations.

7. A snow thrower comprising a housing supported on ground engaging wheels and having a transversely extending discharge chute, an impeller including a support assembly rotatably mounted on said housing below said discharge chute for rotation about a transverse axis and comprising a pair of laterally spaced hub members, a plurality of elongated, transversely extending shell members carried by said hub members, each of said shell members including a body portion terminating at one transverse edge in a first blade mounting section and terminating at the opposite transverse edge in a second blade mounting section, said shell members being mounted on said hub members with a said first blade mounting section of one shell member and a said second blade mounting section of another shell member secured together in overlapping relationship, a plurality of elongated axially extending blades corresponding in number to the number of said shell members and having a length substantially coextensive with the width of said discharge chute, each of said blades including a body sandwiched between said overlapping blade mounting sections and having leading and trailing edges, and a propelling section which extends radially outwardly from said trailing edge and which is in the form of a continuous series of corrugations with alternating ridges and furrows defining a plurality of generally V-shaped pockets into which snow is compacted and from which snow is propelled toward said discharge chute during rotation of said impeller, means for securing said impeller blades on said support assembly, and a power source for rotating said impeller.

8. An impeller for a snow thrower comprising an axially extending blade adapted to be mounted for rotation and including a generally planar web section and a propelling section extending from and obliquely to said web section and being in the form of a continuous series of corrugations with alternating ridges and furrows defining a plurality of V-shaped pockets.

9. An impeller for a snow thrower comprising a rotatable, axially-elongated, support assembly and an elongated, axially extending blade mounted on said support assembly and including a body including a generally planar web section having leading and trailing edges with respect to the direction of rotation of said support assembly, said blade also including a propelling section which extends radially outwardly at an obligue angle to said web section and which is in the form of a continuous series of corrugations with alternating ridges and furrows defining a plurality of V-shaped pockets.

10. An impeller according to claim 9 wherein said body and propelling section are formed as a one-piece unit.

11. An impeller according to claim 9 wherein said propelling section has a substantially uniform thickness except for a thickened tip portion in the vicinity adjacent each ridge of said corrugations.

12. An impeller for a snow thrower comprising a rotatable, axially-elongated support assembly including a pair of laterally spaced hub members, a plurality of elongated, transversely extending shell members carried by said hub members, each of said shell members including a body portion terminating at one transverse edge in a first blade mounting section and terminating at the opposite transverse edge in a second blade mounting section, said shell members being mounted on said hub members with a said first blade mounting section of one shell member and a said second blade mounting section of another shell member secured together in overlapping relationship, a plurality of axially elongated blades corresponding in number to the number of said shell members and including a body sandwiched between said overlapping blade mounting sections and having leading and trailing edges with respect to the direction of rotation of said support assembly, and a propelling section which extends radially outwardly from said trailing edge and which is in the form of a continuous series of corrugations with alternating ridges and furrows defining a plurality of V-shaped pockets.

13. A snow thrower comprising a housing supported on ground engaging wheels and having a transversely extending discharge chute, an impeller mounted on said housing below said discharge chute for rotation about a transverse axis, and an elongated axially extending blade having a length substantially coextensive with a width of said discharge chute, said blade including a generally planar web section, and a propelling section extending from and obliquely to said web section and being in the form of a continuous series of corrugations with alternating ridges and furrows defining a plurality of generally V-shaped pockets into which snow is compacted and from which snow is propelled toward said discharge chute during rotation of said impeller, and a power source for rotating said impeller.

* * * * *